US010813203B2

(12) United States Patent
Kawase et al.

(10) Patent No.: US 10,813,203 B2
(45) Date of Patent: Oct. 20, 2020

(54) X-RAY GENERATING APPARATUS

(71) Applicant: CANON KABUSHIKI KAISHA, Tokyo (JP)

(72) Inventors: Junya Kawase, Yokohama (JP); Koji Yamazaki, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/311,131

(22) PCT Filed: Sep. 28, 2017

(86) PCT No.: PCT/JP2017/035263
§ 371 (c)(1),
(2) Date: Dec. 18, 2018

(87) PCT Pub. No.: WO2018/079176
PCT Pub. Date: May 3, 2018

(65) Prior Publication Data

US 2019/0150255 A1 May 16, 2019

(30) Foreign Application Priority Data

Oct. 28, 2016 (JP) ..... 2016-212124

(51) Int. Cl.

| | |
|---|---|
| ***H05G 1/32*** | (2006.01) |
| ***H05G 1/06*** | (2006.01) |
| ***H01J 35/16*** | (2006.01) |
| *H01J 35/08* | (2006.01) |

(52) U.S. Cl.
CPC ..... *H05G 1/06* (2013.01); *H01J 35/16* (2013.01); *H01J 35/116* (2019.05)

(58) Field of Classification Search
CPC ..... H05G 1/06; H01J 35/16; H01J 35/116
See application file for complete search history.

(56) References Cited

U.S. PATENT DOCUMENTS

| | | | | |
|---|---|---|---|---|
| 7,949,099 | B2 | 5/2011 | Klinkowstein | |
| 9,131,590 | B2 * | 9/2015 | Suzuki | H05G 1/025 |
| 2015/0030127 | A1 * | 1/2015 | Aoki | H01J 35/16 378/62 |
| 2015/0098552 | A1 | 4/2015 | Draper | |

FOREIGN PATENT DOCUMENTS

| | | | |
|---|---|---|---|
| FR | 2415876 | A1 | 8/1979 |
| JP | 2015-58180 | A | 3/2015 |
| WO | 2017/002363 | A1 | 1/2017 |

* cited by examiner

*Primary Examiner* — Kiho Kim
(74) *Attorney, Agent, or Firm* — Canon U.S.A., Inc. IP Division

(57) ABSTRACT

In an X-ray generating apparatus 101 in which an X-ray tube 102 is anode-grounded to a protruding portion 107*c* of a container 107, electrical discharge between the X-ray tube 102 and the container 107 is reduced. The container 107 includes the protruding portion 107*c* in such a way that, in the axial direction Dt, a bent portion 107*d* is positioned between an anode-side joint portion 128 where the insulating tube 4 and the anode 103 are joined to each other and a cathode-side joint portion 122 where the insulating tube 4 and the cathode 104 are joined to each other.

20 Claims, 10 Drawing Sheets

X-RAY GENERATING APPARATUS

TECHNICAL FIELD

The present invention relates to an X-ray generating apparatus including an X-ray tube.

BACKGROUND ART

Some existing X-ray generating apparatuses include an X-ray tube including a transmission target. Such an X-ray generating apparatus has a metal container that is grounded and filled with an insulating liquid, and an X-ray tube and a drive circuit for driving the X-ray tube are contained in the metal container. This structure, in which an X-ray tube is contained in a metal container, is called a monotank structure. The monotank structure enables an X-ray generating apparatus to have not only a smaller size but also high reliability such that electrical discharge is not likely to occur even when high tube voltage is applied.

In general, in an X-ray generating apparatus having the monotank structure, the electric potentials of the anode and the cathode of the X-ray tube relative to the grounded metal container are determined by using either of two grounding methods, which are a neutral-point grounding manner and an anode grounding method.

In an X-ray generating apparatus using the neutral-point grounding manner, a bipolar voltage source applies +½ Va and −½ Va respectively to the anode and the cathode of the X-ray tube so that a tube voltage Va is applied. In the X-ray generating apparatus using the neutral-point grounding manner, the X-ray tube is mounted in a state in which the X-ray tube, including the anode, is completely immersed in the insulating liquid.

PTL 1 describes an X-ray generating apparatus that includes a transmission X-ray tube using a neutral-point grounding manner and that has a monotank structure.

With the neutral-point grounding manner described in PTL 1, the maximum voltage difference with respect to the common ground electrode and the metal container is ½ of the tube voltage Va. This method is advantageous in achieving both of reduction in size of the X-ray generating apparatus and high electrical reliability.

On the other hand, the X-ray generating apparatus using the neutral-point grounding manner, which is suitable for reduction in size, is not suitable for magnified imaging because the X-ray target is disposed in the container and therefore reduction of the distance between an X-ray generator and an object is limited.

In an X-ray generating apparatus using the anode grounding method, the anode of the X-ray tube and the metal container are grounded, and a monopolar voltage source applies a potential −Va (negative tube voltage) to the cathode. The anode may be regarded as a part of the metal container or a part of the monotank. Accordingly, the anode of the X-ray tube, which uses the anode grounding method and mounted in the container, is partially exposed to the outside of the monotank, and the insulating tube and the cathode are completely immersed in the insulating liquid.

In an X-ray generating apparatus including a transmission X-ray tube using the anode grounding method, the X-ray target is disposed on a wall surface of the metal container or outside of the metal container. Therefore, it is possible to locate the X-ray generator close to an object, and the X-ray generating apparatus is suitable for magnified imaging. In general, the magnification ratio is determined by the ratio of the distance (SID) between an X-ray generator and an X-ray detection surface to the distance (SOD) between the X-ray generator and an object. Here, "SID" and "SOD" are abbreviations for "source image-receptor distance" and "source object distance", respectively. PTL 2 describes an X-ray generating apparatus that has a monotank structure and in which the anode of an anode-grounded transmission X-ray tube protrudes to the outside of a container.

CITATION LIST

Patent Literature

[PTL 1]
U.S. Pat. No. 7,949,099
[PTL 2]
Japanese Patent Laid-Open No. 2015-58180

SUMMARY OF INVENTION

Technical Problem

The X-ray generating apparatus described in PTL 2, in which the anode of the anode-grounded transmission X-ray tube protrudes to the outside of the container, has the following problem: the X-ray generating apparatus may not be able to achieve both of reduction of SOD and stable application of a tube voltage and therefore at least one of magnified imaging and stable imaging may be limited.

The present invention provides an X-ray generating apparatus that can perform magnified imaging and in which electrical discharge between an X-ray tube a container is reduced.

Solution to Problem

According to the present invention, an X-ray generating apparatus includes an X-ray tube including a cathode including an electron emission source, an anode including a transmission target, and an insulating tube joined to each of the anode and the cathode; and an electroconductive container that contains the X-ray tube. The container includes a flange portion that extends toward the insulating tube and a protruding portion that protrudes from the flange portion and to which the anode is fixed.

Further features of the present invention will become apparent from the following description of exemplary embodiments with reference to the attached drawings.

DESCRIPTION OF EMBODIMENTS

Hereinafter, embodiments of the present invention will be described with reference to the drawings.

First Embodiment

[X-Ray Generating Apparatus]

Figure 1A:
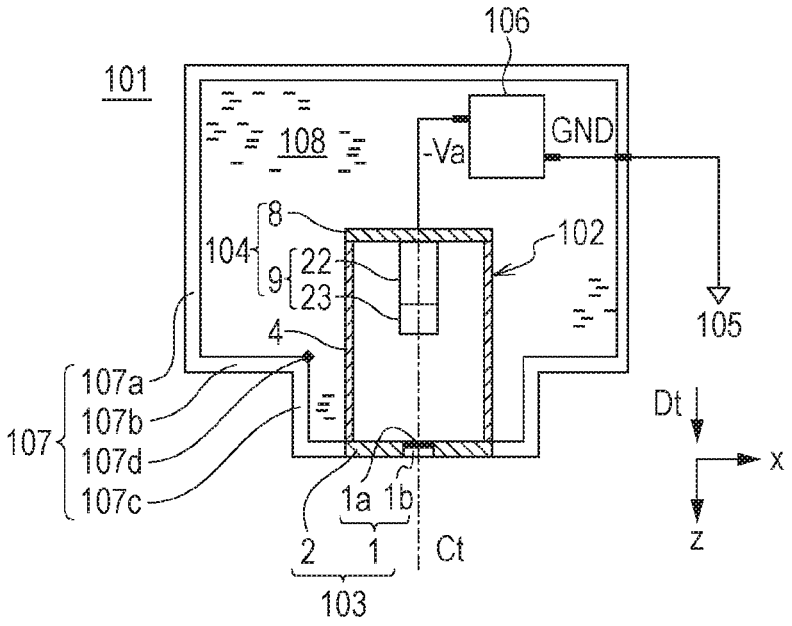
FIG. 1A is a sectional view of an X-ray generating apparatus according to a first embodiment of the present invention.
Figure 1B:
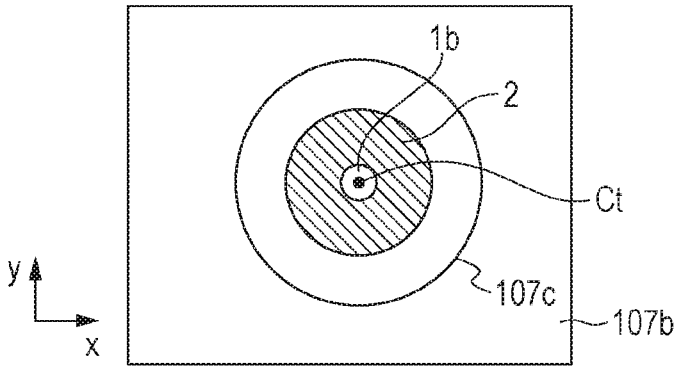
FIG. 1B is a front view of the X-ray generating apparatus according to the first embodiment of the present invention.
Figure 1C:
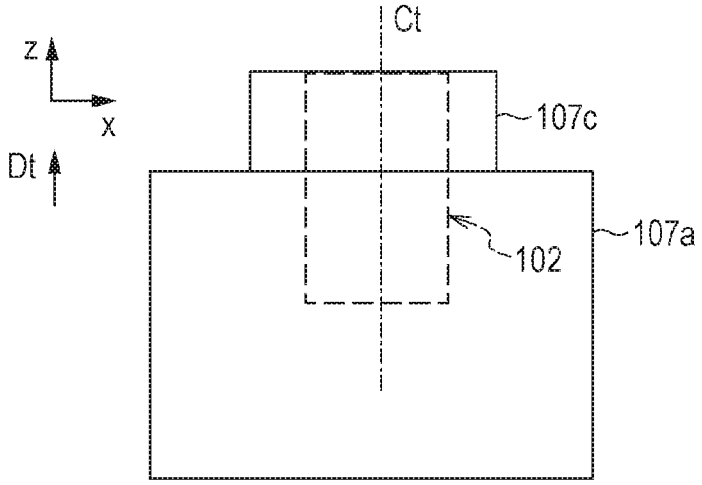
FIG. 1C is a top view of the X-ray generating apparatus according to the first embodiment of the present invention.
Figure 1D:
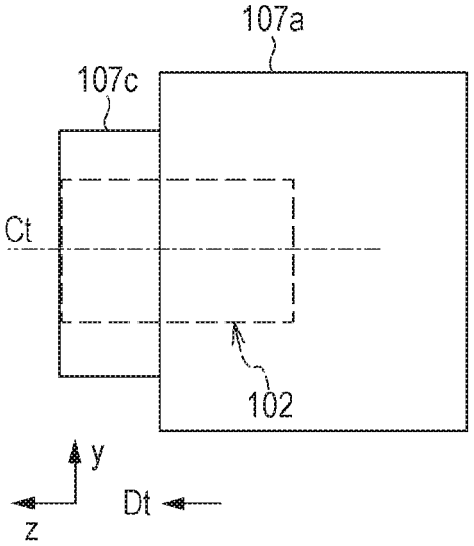
FIG. 1D is a side view of the X-ray generating apparatus according to the first embodiment of the present invention.

FIG. 1A is a sectional view of an X-ray generating apparatus 101 according to a first embodiment of the present invention. FIGS. 1B to 1D are respectively a front view, a top view, and a side view of the X-ray generating apparatus 101. In the present specification and the drawings, the z-axis extends in the axial direction Dt of an X-ray tube and the x-y plane extends in the radial direction of the X-ray tube. The z-coordinate of an emission surface of a transmission target is 0, the direction in which X-rays are emitted out of a container 107 is the positive z-direction, and the direction toward a cathode 104 is the negative z-direction. In other words, the direction from the cathode 104 toward an anode 103 is the positive z-direction.

The X-ray generating apparatus 101 includes an X-ray tube 102, an insulating liquid 108, and the container 107 that contains the X-ray tube 102 and the insulating liquid 108. The present invention is characterized in that the container 107 and the X-ray tube 102 have a special positional relationship. The positional relationship will be described below.

[X-Ray Tube]

The X-ray tube 102 according to the first embodiment is a transmission X-ray tube. The X-ray tube 102 includes the anode 103 including a transmission target 1, the cathode 104 including an electron emission source 9, and an insulating tube 4. The insulating tube 4 is joined to the anode 103 and the cathode 104 respectively at one end and the other end thereof, and insulates the anode 103 and the cathode 104 from each other. The insulating tube 4, the anode 103, and the cathode 104 form a vacuum sealed container.

The anode 103 includes the transmission target 1 and an annular anode member 2. The transmission target 1 includes a target layer 1*a* and a support window 1*b* that supports the target layer 1*a*. The anode member 2 is electrically connected to the target layer 1*a* and is joined to the support window 1*b*. The anode member 2 and the support window 1*b* are hermetically sealed along an annular line by using a brazing material.

The target layer 1*a*, including heavy metals such as tungsten and tantalum, generates X-rays when irradiated with electrons. The thickness of the target layer 1*a* is determined based on the balance between the penetration depth of electrons, which contributes to generation of X-rays, and the self-attenuation of generated X-rays that pass through the target layer 1*a* toward the support window 1*b*. The thickness may be in the range of 1 μm to several tens of μm.

The support window 1*b* has a function of an end window that transmits X-rays generated in the target layer 1*a* and emits the X-rays to the outside of the X-ray tube 102. The support window 1*b* is made of a material that can transmit X-rays. Examples of the material include beryllium, aluminium, silicon nitride, and an isotope of carbon. The support window 1*b* may be made of diamond, which has high thermal conductivity, so that heat of the target layer 1*a* can be effectively transferred to the anode member 2.

The insulating tube 4 is made of a material having vacuum hermeticity and insulating property. Examples of the material include ceramic materials, such as alumina and zirconia, and grass materials, such as soda lime and quartz. In order to reduce thermal stress between the insulating tube 4 and a cathode member 8 and the anode member 2, the cathode member 8 and the anode member 2 are made of a material that has linear expansion coefficients ac (ppm/° C.) and αa (ppm/° C.) that are close to the linear expansion coefficient αi (ppm/° C.) of the insulating tube 4. Examples of the material include alloys, such as Kovar and Monel.

In the present specification, the axial direction Dt and the axis Ct of the X-ray tube 102 are defined as the axial direction and the axis of the insulating tube 4.

The cathode 104 includes the electron emission source 9 and the cathode member 8. The electron emission source 9 includes a head portion 23 including an electron emitter and a neck portion 22 that fixes the head portion to the cathode member 8. The cathode member 8 is annular and joined to the electron emission source 9.

The electron emission source 9 is brazed to the cathode member 8 by using a brazing material or thermally fused to the cathode member 8 by laser welding or the like. The head portion 23 of the electron emission source 9 includes an electron emitter that is, for example, an impregnated thermionic electron source, a filament thermionic electron source, or a cold cathode electron source. The head portion 23 may include an electrode (not shown) that defines a static electric field, such as an extraction grid electrode or a converging lens electrode. The neck portion 22 is shaped like a hollow cylinder or a plurality of columns extending in the axial direction so that wires that are electrically connected to the electron emitter and an electrostatic lens electrode can extend therethrough.

The X-ray tube 102 according to the first embodiment is a transmission X-ray tube. As illustrated in FIG. 1A, the X-ray tube 102 is fixed to the container 107 so as to use the anode grounding method. The anode 103 of the X-ray tube 102 is grounded by being electrically connected to a ground terminal 105 through the container 107, which is electroconductive. The cathode 104 of the X-ray tube 102 is electrically connected to the negative electrode terminal of a tube drive circuit 106 and is electrically connected to a ground terminal through the positive electrode terminal of the tube drive circuit 106. The tube drive circuit 106 includes a tube voltage driver (not shown) that outputs a tube voltage Va. The potential of the positive electrode terminal of the tube drive circuit 106 is defined as a ground potential, and the negative electrode terminal of the tube drive circuit 106 outputs a potential −Va (V). The tube drive circuit 106 includes an electron quantity controller (not shown) that controls the quantity of electrons emitted from the electron emitter.

[Container]

The container 107 has a sealed structure and contains the insulating liquid 108, the X-ray tube 102, and the tube drive circuit 106. The container 107 includes a rear containing portion 107*a* that contains the tube drive circuit 106, a flange portion 107*b*, and a protruding portion 107*c*. The rear containing portion 107*a* and the flange portion 107*b* are sealed along a closed line so as to be liquid-tight. The flange portion 107*b* and the protruding portion 107*c* are sealed along an annular line so as to be liquid-tight.

In the first embodiment, each of the rear containing portion 107*a*, the flange portion 107*b*, and the protruding portion 107*c* has electroconductivity so that the entirety of the container 107 can have the same potential (ground potential). By grounding the container 107 in this way, the electrical stability of the X-ray generating apparatus 101 is ensured. Each of the rear containing portion 107*a*, the flange portion 107*b*, and the protruding portion 107*c* may be made of a metal material in consideration of electroconductivity and strength.

The container 107 is vacuum filled with the insulating liquid 108 so that no bubbles are present between the X-ray tube 102 and the tube drive circuit 106. This is because bubbles in the insulating liquid 108 are regions having lower permittivity than surrounding regions of the insulating liquid 108 and may induce electrical discharge. The insulating liquid 108 has a function of exchanging heat by convection due to uneven distribution of temperatures among components disposed in the container. The insulating liquid 108 has a function of reducing uneven temperature distribution in the container 107; a function of dissipating heat in the container 107 to the outside through the walls of the container 107; and a function of reducing electrical discharge among the X-ray tube 102, the tube drive circuit 106, and the container 107. To be specific, a fluid that has resistance to heat corresponding to the operation temperature range of the X-ray generating apparatus 101, fluidity, and electrical insulating property is used as the insulating liquid 108. Examples of the fluid include a chemically synthesized oil, such as silicone oil or fluororesin oil; a mineral oil; and an insulating gas, such as SF6.

[Positional Relationship Between Portions of Container and X-Ray Tube]

Referring to FIGS. 1A to 1D, the positional relationships among the X-ray tube 102 and the rear containing portion 107*a*, the flange portion 107*b*, and the protruding portion 107*c* of the container according to the present invention will be described.

The X-ray generating apparatus 101 according to the first embodiment includes the protruding portion 107*c* having a cylindrical shape, and the anode 103 of the X-ray tube 102 is joined to the protruding portion 107*c*.

The anode 103 of the X-ray tube 102 is joined to an opening formed in the cylindrical protruding portion 107*c*, and thereby the X-ray tube 102 is fixed to the container 107. The tube drive circuit 106 is fixed to the rear containing portion 107*a* of the container by using a fixing member (not shown). It is possible to selectively dispose the X-ray tube 102 in the protruding portion 107*c* of the container 107 by dividing the rear containing portion 107*a*, which is continuous with the flange portion 107*b* along a closed line, into a part for fixing and containing the X-ray tube 102 and a part for fixing the tube drive circuit 106.

Figure 6:
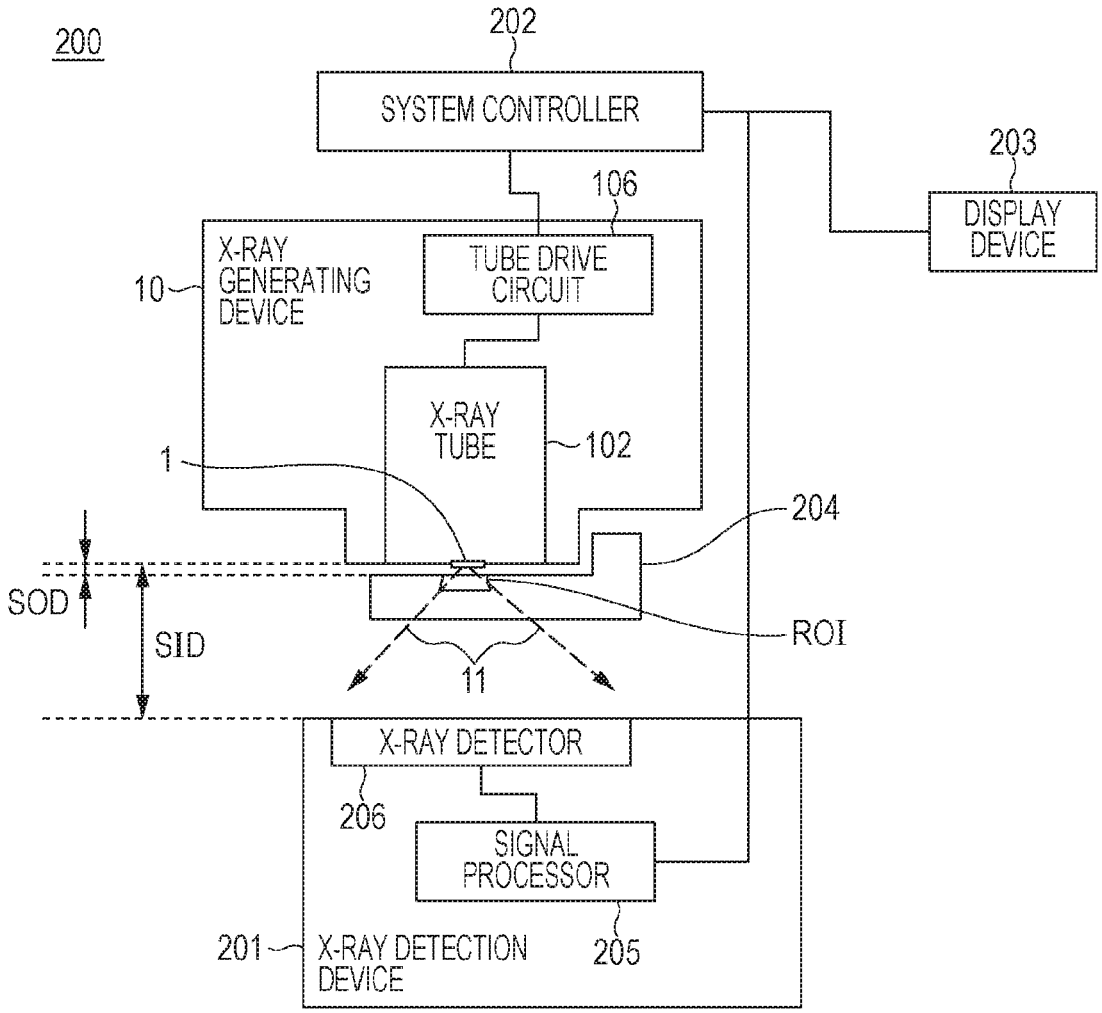
FIG. 6 is a block diagram illustrating an X-ray imaging system according to a ninth embodiment of the present invention.

If, in an X-ray imaging system such as one illustrated in FIG. 6, the anode of an X-ray tube were fixed to a container that does not have a protruding portion, a part of the container that faces an object and that is located close to the object would have a large area, and it would be difficult to reduce the source image-receptor distance SID.

In contrast, the container 107 includes the flange portion 107*b*, which is continuous with the rear containing portion 107*a* along a closed line, which extends toward the insulating tube 4 from a part continuous with the rear containing portion 107*a*, and which surrounds the insulating tube 4. The container 107 further includes the protruding portion 107*c*, which is continuous with the flange portion 107*b* along an annular line, which includes a part protruding from the flange portion 107*b* in a direction away from the rear containing portion 107*a*, and to which the anode 103 is fixed. The container 107 includes a bent portion 107*d* between the protruding portion 107*c* and the flange portion 107*b*. The protruding portion 107*c* and the flange portion 107*b* are continuous with each other along an annular line with the bent portion 107*d*, which annularly extends along the inner surface of the container 107, therebetween. In other words, the bent portion 107*d* is positioned in a part of the container 107 that protrudes into the container 107. In other words, the flange portion 107*b* annularly extends so that the bent portion 107*d* surrounds the insulating tube 4.

Since the protruding portion 107*c* protrudes from the flange portion 107*b* with the bent portion 107*d* therebetween, it is possible to position the transmission target 1, at which an electron beam is focused and X-rays are generated, at an end of the protruding portion 107*c* of the container 107.

As a result, when the X-ray generating apparatus 101 according to the present invention is used in an X-ray imaging system 200 illustrated in FIG. 6, the X-ray imaging system 200 can have high magnification ratio and effectively perform high resolution imaging. That is, it is possible to effectively reduce the source object distance SOD relative to the source image-receptor distance SID between the X-ray generating apparatus 101 and an X-ray detector 206, for which the area of the detection surface is actually limited; and it is possible to increase the magnification ratio SID/SOD. As a result, it is possible to locate the transmission target 1, which is the X-ray generator of the X-ray generating apparatus 101, close to a region of interest ROI of an object 204 having a part protruding toward the X-ray generating apparatus 101, while preventing the X-ray generating apparatus 101 from colliding with the object 204. Examples of the object 204 having a protruding part include a semiconductor substrate on which a plurality of devices having different heights are mounted.

As illustrated in FIG. 1A, in the axial direction Dt (z-direction), the bent portion 107*d* is positioned between an anode-side joint portion 128, where the insulating tube 4 and the anode 103 are joined to each other, and a cathode-side joint portion 122, where the insulating tube 4 and the cathode 104 are joined to each other. By disposing the X-ray tube 102 in the container 107 in this way, it is possible to provide the X-ray generating apparatus 101 that can perform magnified imaging and that has high reliability. That is, disposing the transmission target 1 at a protruding position of the container 107 has a technical advantage in that is it suitable for magnified imaging. Moreover, since the bent portion 107*d*, which has the same potential as the anode, is disposed so as to be separated from the cathode 104, it is possible to reduce electrical discharge and to ensure the reliability of the X-ray generating apparatus 101. Such disposition is equivalent to separating the bent portion 107*d*, which has the same potential as the anode, from a triple point (joint portion between the cathode 104 and the insulating tube 4), and therefore electrical discharge of the X-ray generating apparatus 101 is reduced.

Note that the expression "the protruding portion 107*c* protrudes from the flange portion 107*b* with the bent portion 107*d* therebetween" has substantially the same meaning as the expression "the container 107 includes a flange portion that extends toward the insulating tube 4 from a part thereof continuous with the rear containing portion 107*a* along a closed line and that surrounds the insulating tube 4".

Figure 2A:
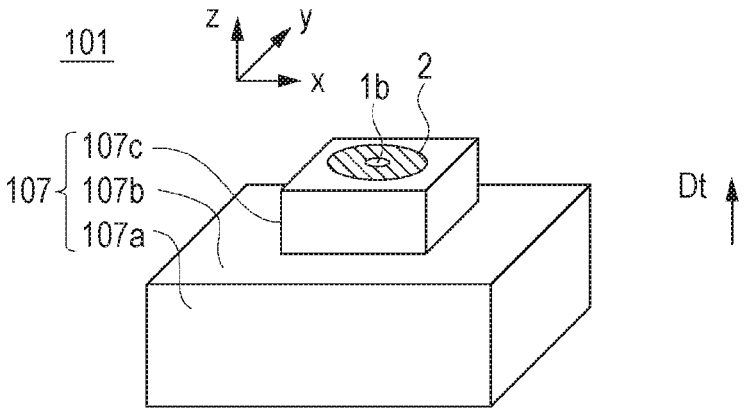
FIG. 2A is a perspective view of an X-ray generating apparatus according to a second embodiment of the present invention.
Figure 2B:
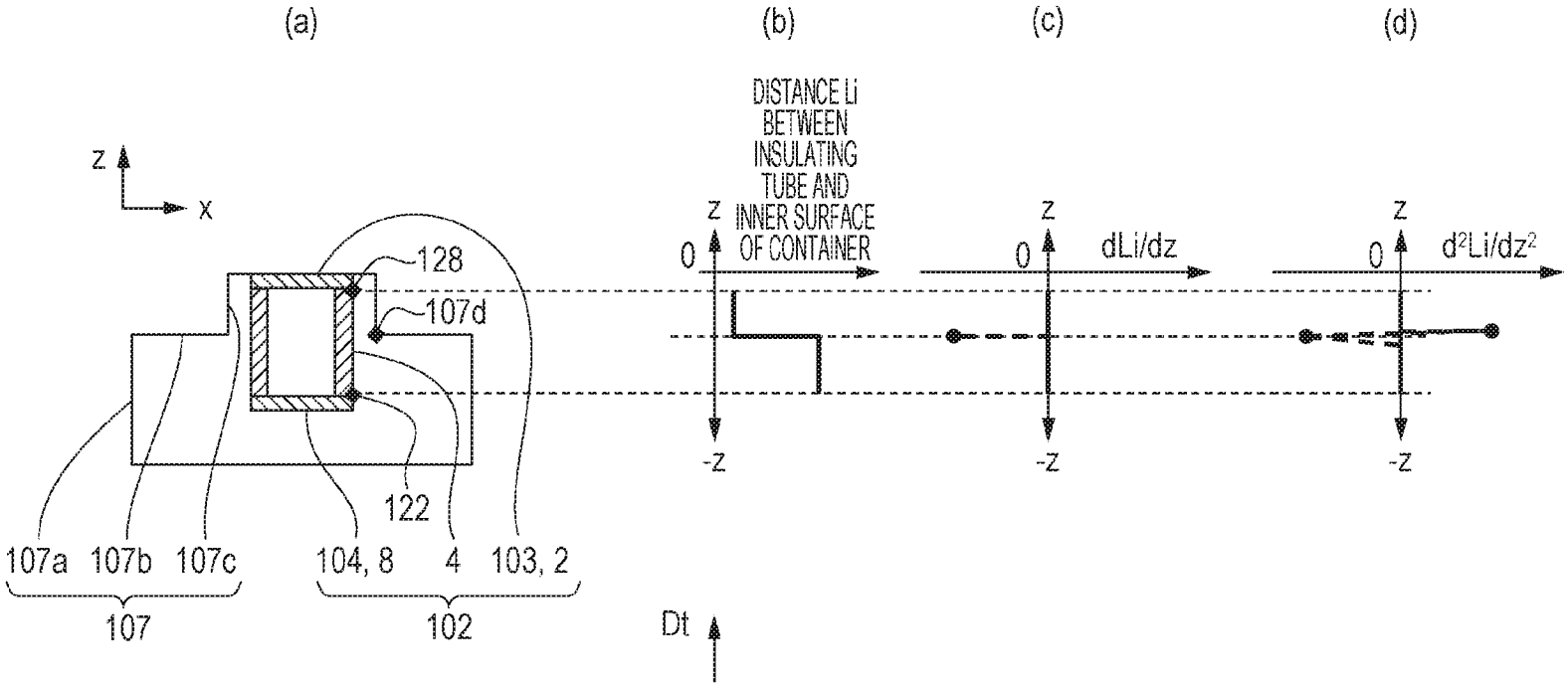
FIG. 2B illustrates a sectional view (a) of the X-ray generating apparatus according to the second embodiment of the present invention and graphs (b), (c), and (d) regarding the distance between an inner surface of a container and an insulating tube.

FIG. 2A is a perspective view of an X-ray generating apparatus 101 according to a second embodiment of the present invention. FIG. 2B illustrates a sectional view (a) of the X-ray generating apparatus 101 and graphs (b), (c), and (d) regarding the distance between an inner surface of a container 107 and an insulating tube 4. In FIG. 2B, in the same way as in other figures of the present specification, the direction from a cathode 104 toward an anode 103 is defined as the positive z-direction, and the a position on an inner surface of the container 107 in the axial direction Dt is denoted by z.

The X-ray generating apparatus 101 according to the second embodiment includes a protruding portion 107*c* having a rectangular parallelepiped shape. The second embodiment differs from the first embodiment in the shapes of a flange portion 107*b*, the protruding portion 107*c*, and a bent portion 107*d*. In the second embodiment, the bent portion 107*d* is rectangular and surrounds the insulating tube 4.

In the graph (b) of FIG. 2B, the distance Li between the insulating tube 4 and the inner peripheral surface of the container 107 is plotted against the position z in the axial direction. In the graph (c) of FIG. 2B, the first derivative of the distance Li with respect to the position z is plotted against the position z. Likewise, in the graph (d) of FIG. 2B, the second derivative of the distance Li with respect to the position z is plotted against the position z.

As illustrated in the sectional view (a) and the graph (c) of FIG. 2B, the bent portion 107*d* overlaps a position where the first derivative of the distance Li between the insulating tube 4 and the container 107 with respect to the position z is locally minimum. As illustrated in the sectional view (a) and the graph (d) of FIG. 2B, the bent portion 107*d* overlaps a position where the sign of the second derivative of the distance Li between the insulating tube 4 and the container 107 with respect to the position z changes from negative to positive. Accordingly, even if the container 107 includes a part having a finite radius of curvature, it is possible to uniquely determine the position of the bent portion 107*d*.

Figure 3A:
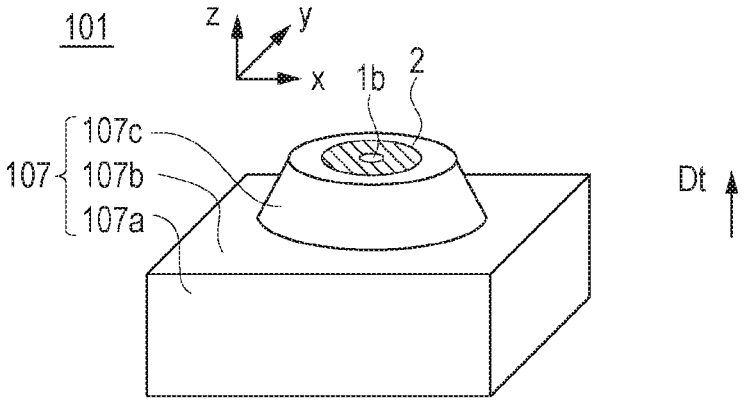
FIG. 3A is a perspective view of an X-ray generating apparatus according to a third embodiment of the present invention.
Figure 3B:
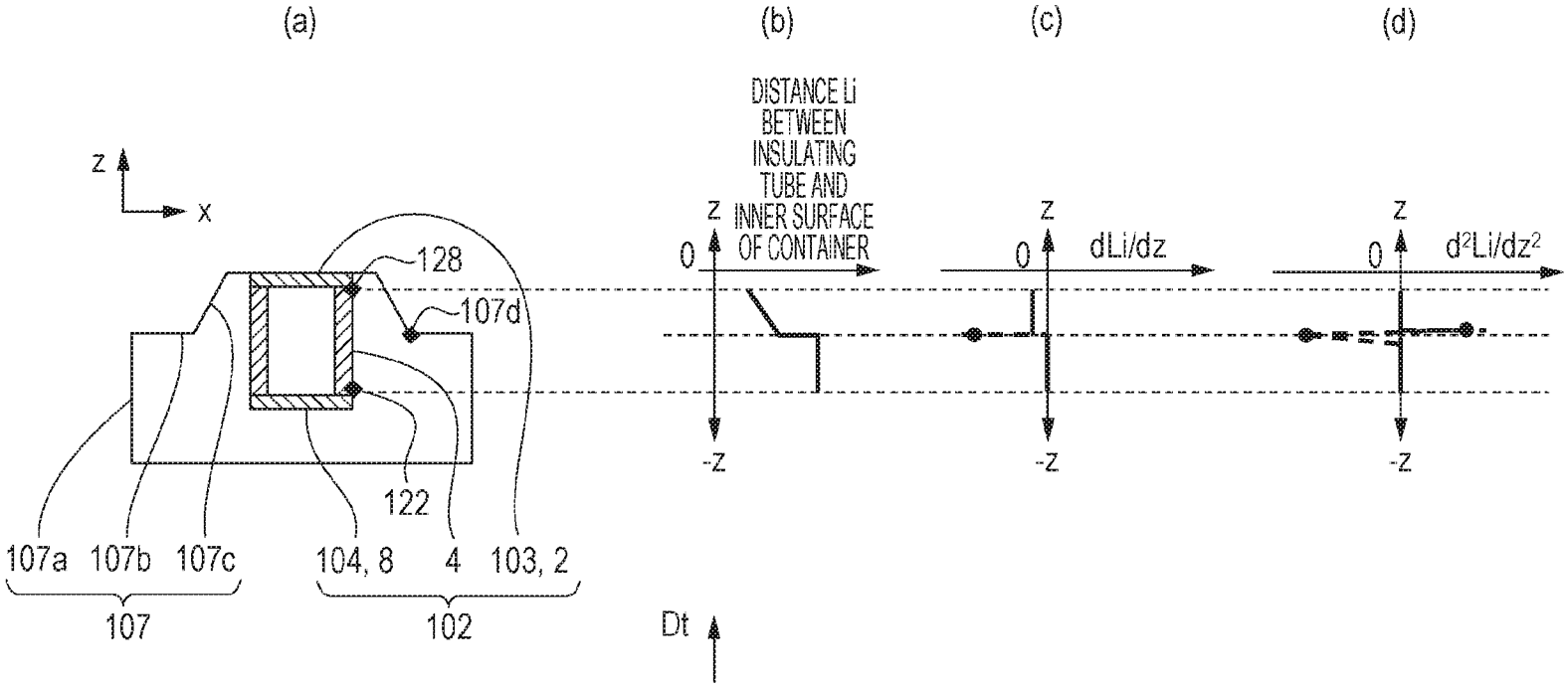
FIG. 3B illustrates a sectional view (a) of the X-ray generating apparatus according to the third embodiment of the present invention and graphs (b), (c), and (d) regarding the distance between an inner surface of a container and an insulating tube.

FIG. 3A is a perspective view of an X-ray generating apparatus 101 according to a third embodiment of the present invention. FIG. 3B illustrates a sectional view (a) of the X-ray generating apparatus 101 and graphs (b), (c), and (d) regarding the distance between an inner surface of a container 107 and an insulating tube 4. The X-ray generating apparatus 101 according to the third embodiment includes a protruding portion 107*c* having a truncated cone shape. The third embodiment differs from the first embodiment in the shape of the protruding portion 107*c* and differs from the second embodiment in the shapes of a flange portion 107*b*, the protruding portion 107*c*, and a bent portion 107*d*. In the third embodiment, the bent portion 107*d* is annular and surrounds the insulating tube 4 as in the first and second embodiments.

In the graph (b) of FIG. 3B, the distance Li between the insulating tube 4 and the inner peripheral surface of the container 107 is plotted against the position z in the axial direction. In the graph (c) of FIG. 3B, the first derivative of the distance Li with respect to the position z is plotted against the position z. Likewise, in the graph (d) of FIG. 3B, the second derivative of the distance Li with respect to the position z is plotted against the position z.

Also in the third embodiment, as illustrated the sectional view (a) and the graph (c) of FIG. 3B, the bent portion 107*d* overlaps a position where the first derivative of the distance Li between the insulating tube 4 and the container 107 with respect to the position z is locally minimum. As illustrated in the sectional view (a) and the graph (d) of FIG. 3B, the bent portion 107*d* overlaps a position where the sign of the second derivative of the distance Li between the insulating tube 4 and the container 107 with respect to the position z changes from negative to positive.

Figure 4A:
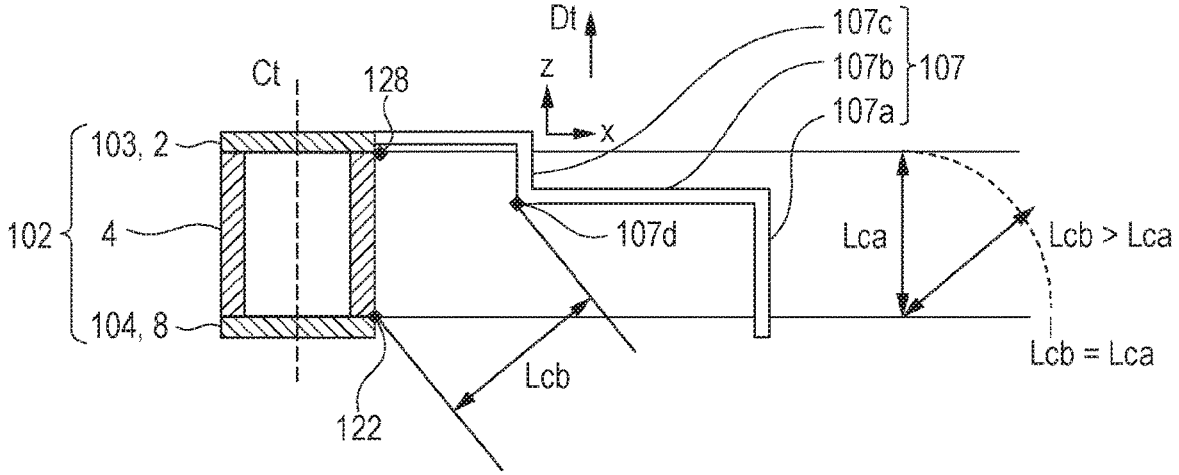
FIG. 4A is a sectional view illustrating a main part of a fourth embodiment of the present invention.
Figure 4B:
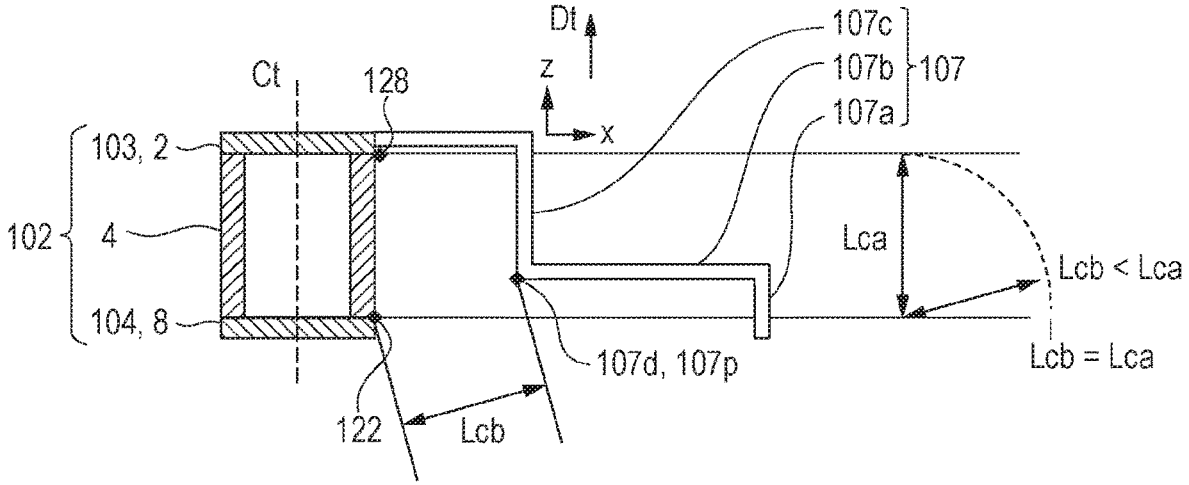
FIG. 4B is a sectional view illustrating a main part of a fifth embodiment of the present invention.
Figure 4C:
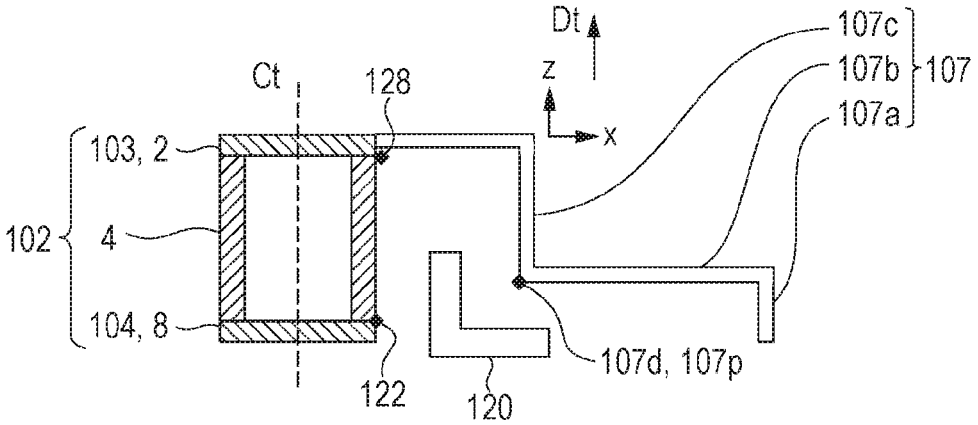
FIG. 4C is a sectional view illustrating a main part of a sixth embodiment of the present invention.

FIGS. 4A to 4C are partial enlarged sectional views of main parts of X-ray generating apparatuses 101 according to fourth, fifth, and sixth embodiments of the present invention. FIGS. 4A to 4C each illustrate a cathode-side joint portion 122 and an anode-side joint portion 128 of the X-ray generating apparatus 101 according to a corresponding one of the fourth to sixth embodiments. A cathode 104 (cathode member 8) and an insulating tube 4 are joined to each other at the cathode-side joint portion 122. An anode 103 (anode member 2) and the insulating tube 4 are joined to each other at the anode-side joint portion 128.

In the fourth embodiment illustrated in FIG. 4A, the distance Lcb between the cathode-side joint portion 122 and a bent portion 107*d* is larger than the distance Lca between the cathode-side joint portion 122 and the anode-side joint portion 128. The fourth embodiment, in which the protruding length of a protruding portion 107*c* is small, is likely to be affected by the height of an object (not shown) when capturing a magnified image of an object. Therefore, the fourth embodiment is not particularly suitable for magnified imaging compared with fifth and sixth embodiments described below. On the other hand, in the fourth embodiment, the cathode-side joint portion 122, which forms a triple point where electric field concentration occurs, is not closer to the bent portion 107*d* than the anode-side joint portion 128 is. Therefore, electrical discharge between the cathode 104 and the container 107 is not likely to occur. In the fourth embodiment, the distance between the bent portion 107*d* and the cathode-side joint portion 122 may be equal to the distance between the anode-side joint portion 128 and the cathode-side joint portion 122.

In the fifth embodiment illustrated in FIG. 4B, the distance Lcb between the cathode-side joint portion 122 and a bent portion 107*d* is smaller than the distance Lca between the cathode-side joint portion 122 and the anode-side joint portion 128. The fifth embodiment, in which the protruding length of a protruding portion 107*c* is large, is less likely to be affected by the height of an object (not shown) when capturing a magnified image of the object than the fourth embodiment. Therefore, the fifth embodiment is more suitable for magnified imaging than the fourth embodiment. On the other hand, in the fifth embodiment, the cathode-side joint portion 122, which forms a triple point where electric field concentration occurs, is closer to the bent portion 107*d* than the anode-side joint portion 128 is. Therefore, voltages resistance between the cathode 104 and the container 107 is reduced, and electrical discharge is more likely to occur than in the fourth embodiment. In other words, the bent portion 107*d* according to the fifth embodiment has a proximal point 107*p* where the distance from the cathode-side joint portion 122 to the inner peripheral surface of the container 107 is smallest. In the fifth embodiment, the distance Lcb between the proximal point 107*p* and the cathode-side joint portion 122 is smaller than the distance Lca between the anode-side joint portion 128 and the cathode-side joint portion 122.

Figure 4D:
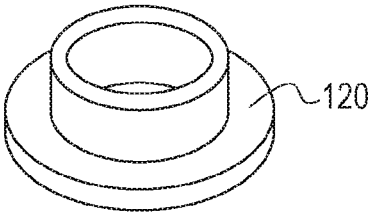
FIG. 4D is a perspective view of a protective member.

The sixth embodiment illustrated in FIG. 4C is a modification of the fifth embodiment. The sixth embodiment differs from the fifth embodiment in that a protective member 120 having insulating property is disposed between the bent portion 107*d* (proximal point 107*p*) and the cathode-side joint portion 122 so that the bent portion 107*d* (proximal point 107*p*) cannot be directly seen from the cathode-side joint portion 122. As illustrated in FIGS. 4C and 4D, the protective member 120 is a tubular member having a shape formed by rotating an L-shaped cross section. The protective member 120 surrounds the X-ray tube 102 so that the bent portion 107*d* (proximal point 107*p*) cannot be directly seen from a region around the cathode-side joint portion 122. The protective member 120 is made from an insulating solid material, such as ceramics, glass, or resin. The protective member 120 may have a volume resistivity of $1\times10^5$ Ωm or higher at 25° C.

Figure 5A:
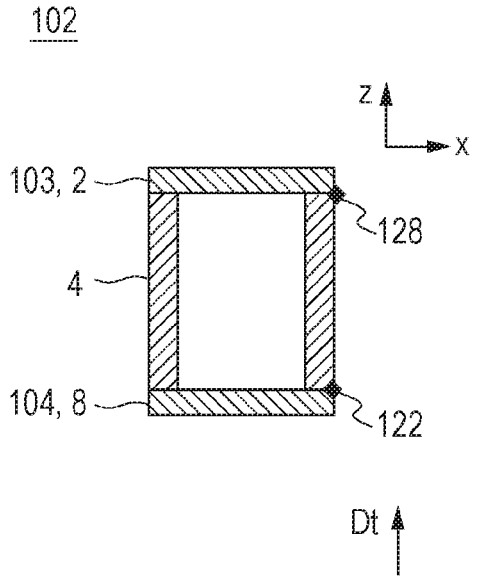
FIG. 5A is a sectional view illustrating an anode-side joint portion and a cathode-side joint portion of an X-ray tube according to a seventh embodiment of the present invention.
Figure 5B:
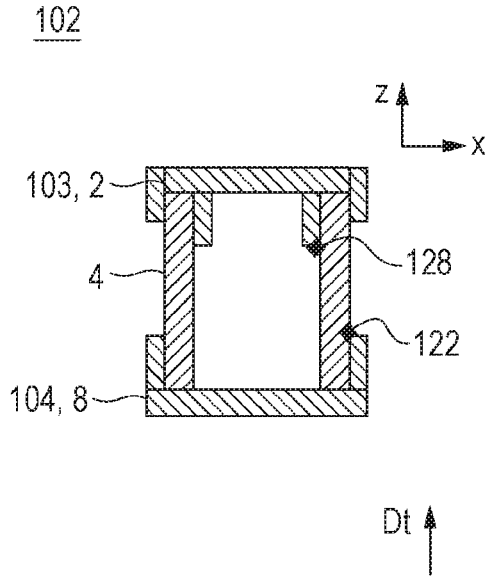
FIG. 5B is a sectional view illustrating an anode-side joint portion and a cathode-side joint portion of an X-ray tube according to an eighth embodiment of the present invention.

Next, referring to FIGS. 5A and 5B, a method of determining the positions of a cathode-side joint portion 122 and an anode-side joint portion 128 will be described. FIGS. 5A and 5B are sectional views illustrating anode-side joint portions 128 and cathode-side joint portions 122 of X-ray tubes 102 according to seventh and eighth embodiments of the present invention.

In the seventh embodiment, an anode member 2 and a cathode member 8, each having a disk-like shape, are joined to an insulating tube 4 at surfaces thereof that face each other. In the seventh embodiment, the cathode-side joint portion 122 corresponds to a cathode-side end portion of the insulating tube 4, and the anode-side joint portion 128 corresponds to an anode-side end portion of the insulating tube 4. Accordingly, the distance Lca between the cathode-side joint portion 122 and the anode-side joint portion 128 is the same as the length of the insulating tube 4 in the axial direction.

The eighth embodiment differs from the seventh embodiment in that the anode member 2 and the cathode member 8 include tubular sleeve portions that protrude in directions such that the sleeve portions face each other. In the eighth embodiment, the cathode-side joint portion 122 is offset from the cathode-side end point of the insulating tube 4 in the axial direction Dt by the protruding length of the sleeve portion of the cathode member 8. Likewise, the anode-side joint portion 128 is offset from the anode-side end point of the insulating tube 4 in the axial direction Dt by the protruding length of the sleeve portion of the anode member 2. Accordingly, the distance Lca between the cathode-side joint portion 122 and the anode-side joint portion 128 is smaller than the length of the insulating tube 4 in the axial direction.

By using the method described above, irrespective of the shapes of the anode member 2, the cathode member 8, and the insulating tube 4, it is possible to determine the positions of the cathode-side joint portion 122 and the anode-side joint portion 128 in regions where electric field concentrates and that are adjacent to facing electrodes.

FIG. 6 is a block diagram of an X-ray imaging system 200 according to a ninth embodiment of the present invention. A system controller 202 controls an X-ray generating apparatus 101 and an X-ray detection device 201 in coordination with each other.

A tube drive circuit 106 outputs various control signals to the X-ray tube 102 under the control by the system controller 202. The X-ray generating apparatus 101 emits X-rays in accordance with control signals output from the system controller 202. An X-ray detector 206 detects X-rays 11 emitted from the X-ray generating apparatus 101 and passed through an object 204. The X-ray detector 206 includes a plurality of detection elements (not shown) and obtains a transmitted X-ray image. The X-ray detector 206 converts the transmitted X-ray image into an image signal and outputs the image signal to a signal processor 205. The signal processor 205 performs predetermined signal processing on the image signal under the control by the system controller 202 and outputs the processed image signal to the system controller 202. Based on the processed image signal, the system controller 202 outputs a display signal to a display device 203 so that the display device 203 can display an image.

The display device 203 displays an image based on the display signal, which is a captured image of the object 204, on a screen. A slit (not shown) having a predetermined gap, a collimator (not shown) having a predetermined opening, or the like may be disposed between the X-ray tube 102 and the object 204 in order to reduce unnecessary irradiation with X-rays. In the ninth embodiment, the object 204 is supported by a placement portion or a transport portion (not shown) so as to be separated by predetermined distances from the X-ray tube 102 and the X-ray detector 206.

The X-ray imaging system. 200 according to the ninth embodiment, which includes the X-ray generating apparatus 101 that is suitable for magnified imaging and in which electrical discharge is reduced, can stably capture a magnified image.

Advantageous Effects of the Invention

With the present invention, it is possible to provide an X-ray generating apparatus that has high reliability due to reduction of electrical discharge and that can perform magnified imaging due to low SOD.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-212124, filed Oct. 28, 2016, which is hereby incorporated by reference herein in its entirety.

The invention claimed is:

1. An X-ray generating apparatus comprising:

an X-ray tube including a cathode including an electron emission source, an anode including a transmission target, and an insulating tube joined to each of the anode and the cathode via an anode-side joint portion and a cathode-side joint portion, respectively;

an insulating liquid, and an electroconductive container including a flange portion extending toward the insulating tube and a protruding portion protruding from the flange portion via a bent portion and to which the anode is fixed and configured to house the X-ray tube and the insulating liquid, wherein a distance between the bent portion and the cathode-side joint portion is equal to or greater than a distance between the anode-side joint portion and the cathode-side joint portion.

2. The X-ray generating apparatus according to claim 1, wherein, in an axial direction of the X-ray tube, the bent portion is positioned between the anode-side joint portion and the cathode-side joint portion.

3. The X-ray generating apparatus according to claim 2, wherein, when a direction from the cathode toward the anode is defined as positive and a position on an inner surface of the container in the axial direction is denoted by z, the bent portion overlaps a position where a first derivative of a distance Li between the insulating tube and the container with respect to z is locally minimum.

4. The X-ray generating apparatus according to claim 2, wherein, when a direction from the cathode toward the anode is defined as positive and a position on an inner surface of the container in the axial direction is denoted by z, the bent portion overlaps a position where a sign of a second derivative of a distance Li between the insulating tube and the container with respect to z changes from negative to positive.

5. An X-ray generating apparatus comprising:

an X-ray tube including a cathode including an electron emission source, an anode including a transmission target, and an insulating tube joined to each of the anode and the cathode via an anode-side joint portion and a cathode-side joint portion, respectively;

an insulating liquid;

an electroconductive container including a flange portion extending toward the insulating tube and a protruding portion protruding from the flange portion via a bent portion including a proximal point where a distance from the cathode-side joint portion to an inner surface of the container is smallest and to which the anode is fixed and configured to house the X-ray tube and the insulating liquid; and a solid insulating member is disposed with the insulating liquid between the bent portion and the cathode-side joint portion, wherein, in an axial direction of the X-ray tube, the bent portion is positioned between the anode-side joint portion and the cathode-side joint portion.

6. The X-ray generating apparatus according to claim 1, wherein the flange portion and the protruding portion are each made of a metal material.

7. The X-ray generating apparatus according to claim 1, wherein the container is grounded.

8. The X-ray generating apparatus according to claim 7, wherein the anode is grounded through the container.

9. The X-ray generating apparatus according to claim 1, further comprising:

a drive circuit that drives the X-ray tube, wherein the drive circuit and the insulating liquid are stored in the container.

10. The X-ray generating apparatus according to claim 9, wherein the container includes a rear containing portion that is continuous with the flange portion along a closed line, and wherein the drive circuit is contained in the rear containing portion.

11. The X-ray generating apparatus according to claim 10, wherein the protruding portion protrudes from the flange portion in a direction away from the rear containing portion.

12. The X-ray generating apparatus according to claim 9, wherein the drive circuit includes an electron quantity controller that controls a quantity of electrons emitted from the electron emission source.

13. The X-ray generating apparatus according to claim 9, wherein the drive circuit includes a tube voltage driver that applies a tube voltage between the anode and the cathode.

14. The X-ray generating apparatus according to claim 1, wherein the transmission target includes a target layer that generates X-rays when irradiated with electrons, and a support window that supports the target layer and transmits the generated X-rays.

15. The X-ray generating apparatus according to claim 1, wherein the insulating tube is positioned between the anode and the cathode.

16. The X-ray generating apparatus according to claim 1, wherein the flange portion annularly extends so that a bent portion surrounds the insulating tube.

17. An X-ray imaging system comprising:

the X-ray generating apparatus according to claim 1;

an X-ray detection device that detects transmitted X-rays emitted from the X-ray generating apparatus and passed through an object; and a system controller that controls the X-ray generating apparatus and the X-ray detection device in coordination with each other.

18. The X-ray generating apparatus according to claim 5, wherein a volume resistivity of the solid insulating member is higher than or equal to $1\times10^5$ Ωm.

19. The X-ray generating apparatus according to claim 5, wherein the solid insulating member and the insulating liquid are located between the proximal point and the cathode-side joint portion so that the proximal point is not directly seen from the cathode-side joint portion.

20. The X-ray generating apparatus according to claim 5, wherein a distance between the proximal point and the cathode-side joint portion is smaller than a distance between the anode-side joint portion and the cathode-side joint portion.

* * * * *